US007243586B2

(12) United States Patent
Keller

(10) Patent No.: US 7,243,586 B2
(45) Date of Patent: Jul. 17, 2007

(54) APPARATUS FOR CUTTING CUSHION-LIKE PACKAGING MATERIAL

(76) Inventor: Reinhard Keller, Rebhalde 10, CH-8421 Dättlikon (CH)

( * ) Notice: Subject to any disclaimer, the term of this patent is extended or adjusted under 35 U.S.C. 154(b) by 503 days.

(21) Appl. No.: 10/266,657

(22) Filed: Oct. 8, 2002

(65) Prior Publication Data

US 2003/0084769 A1 May 8, 2003

(30) Foreign Application Priority Data

Oct. 8, 2001 (CH) ..... 2001 1853/01

(51) Int. Cl.
*B26D 7/00* (2006.01)

(52) U.S. Cl. ..... 83/411.5; 83/616; 493/967

(58) Field of Classification Search ..... 83/411.5, 83/583, 616, 909, 658; 493/350, 185, 967; 100/94, 70 A
See application file for complete search history.

(56) References Cited

U.S. PATENT DOCUMENTS

| | | | | |
|---|---|---|---|---|
| 3,240,094 | A * | 3/1966 | Van Endert | 83/636 |
| 3,600,995 | A | 8/1971 | Hanni | |
| 3,732,770 | A * | 5/1973 | Ottavan | 83/572 |
| 3,754,492 | A * | 8/1973 | Krauss | 83/380 |
| 3,803,968 | A * | 4/1974 | Black | 83/620 |
| 3,841,183 | A * | 10/1974 | Van Zyl | 83/157 |
| 3,924,504 | A * | 12/1975 | Kurtz | 83/568 |
| 4,627,167 | A * | 12/1986 | Karubian et al. | 30/228 |
| 4,738,018 | A * | 4/1988 | Ebrahimian | 29/560 |
| 4,846,034 | A * | 7/1989 | Liet | 83/157 |
| 5,410,929 | A * | 5/1995 | Wallace | 83/160 |
| 5,569,146 | A * | 10/1996 | Simmons | 493/352 |
| 5,718,157 | A * | 2/1998 | Hawley et al. | 83/155 |
| 5,916,346 | A * | 6/1999 | Neal | 83/659 |
| 6,398,703 | B1 * | 6/2002 | Keller | 493/350 |

FOREIGN PATENT DOCUMENTS

| | | |
|---|---|---|
| CH | 0645568 | 10/1984 |
| DE | 3615419 | 11/1987 |
| DE | 3700914 | 8/1988 |
| DE | 3907736 | 5/1990 |
| DE | 9302327 | 12/1993 |
| DE | 9715552 | 10/1998 |
| WO | 9936252 | 7/1999 |

* cited by examiner

*Primary Examiner*—Boyer D. Ashley
*Assistant Examiner*—Phong Nguyen
(74) *Attorney, Agent, or Firm*—Abelman, Frayne & Schwab

(57) ABSTRACT

The apparatus for cutting cushion-like packaging material from a web-like supply of material having at least two layers has a base plate (1), a fixed knife (2) and a movable knife (3), which are arranged above the base plate (1), as well as a drive arrangement for the movable knife. The base plate (1) is connected to a shaft (6) for feeding the packaging material. The drive mechanism is connected drive-wise to the movable knife. A counter-holder (5) with a support surface (22) to support the packaging material during cutting and a means for holding (23) the counter-holder (5) above the fixed knife (2) are provided, the whole being such that the support surface (22) is flush with the cutting edge (17) of the fixed knife. By means of the counter-holder, the cutting is improved in an advantageous manner and paper jams are avoided.

8 Claims, 2 Drawing Sheets

APPARATUS FOR CUTTING CUSHION-LIKE PACKAGING MATERIAL

BACKGROUND OF THE INVENTION

1. Field of the Invention

The invention relates to an apparatus for cutting cushion-like packaging material from a web-like supply of material, consisting of at least two layers.

2. Description of the Prior Art

The known apparatuses for the manufacture of cushion-like packaging material from a web-like supply, consisting of at least two layers, in particular paper, contain a supply shaft, which deforms the supply material into a strip with bead-like or bulging side edges and a multi-layered middle region, a device which joins the middle region together by embossing and a cutting device, which cuts the packaging material from the strip.

The WO 99/36252 describes an apparatus for cutting cushion-like packaging material. In this apparatus a movable knife for cutting is driven by a drive apparatus and re-set back by means of springs.

Prior to cutting, the strip has a cross-sectional shape, which essentially corresponds to a figure of eight. The side edges consist of loose layers lying one on top of the other irregularly and are deformable, whereas the middle region is relatively stiff due to the embossing. In the known apparatuses, cutting takes place as a rule in the region of the outlet end of the supply shaft. During cutting the cushion material to be cut is only supported by the shaft wall below the cutting line. On the other hand; the cushion material is freely movable above the cutting line. Due to the required knife clearance of approximately 0.02 mm, this arrangement has the following disadvantages: during the cutting process by means of the movable knife, the packaging material is diverted in the direction of the fixed knife due to the prevailing cutting force and consequently individual layers of the bead or bulge in the edge region of the knife are not cut at the prescribed cut-ting line. Thus protruding sections occur at individual layers above the cutting line, which are dragged in between the knives. The layers are of a prescribed thickness, wherein three layers are approximately 0.06 mm thick. This means that if three layers are dragged in for example, the re-setting force of the springs is not sufficient to pull back the movable knife. This disturbance is termed a paper jam. Moreover, during cutting, the cutting edges of the knives sliding on each other are worn away, particularly in the "automatic" operating mode, intensifying the formation of residues and increasing the frequency of paper jams.

The object of the invention is an apparatus in which the above-discussed disadvantage is overcome.

SUMMARY OF THE INVENTION

The object of the invention is achieved by providing an apparatus for the cutting of cushion-like packaging material from a web-like supply of material and having a base plate, a fixed knife and at least one movable knife, which are arranged above the base plate, a drive apparatus for the movable knife, wherein the base plate is connected to a shaft for supplying the packaging material and the drive apparatus is connected drive-wise to the movable knife by a counter-holder for supporting the packaging material during cutting, and means for holding the counter holder above the fixed knife, the whole being of such a kind that a support surface is flush with the cutting edge of the fixed knife.

The advantages of the invention are to be seen in the fact that by avoiding paper jams even at high cutting cadence, a faultless cutting of the cushion material takes place and the operating reliability is increased.

BRIEF DESCRIPTION OF THE DRAWINGS

The invention is described below with reference to the accompanying drawings. The drawings show.

DETAILED DESCRIPTION OF THE PREFERRED EMBODIMENTS

Figure 1:
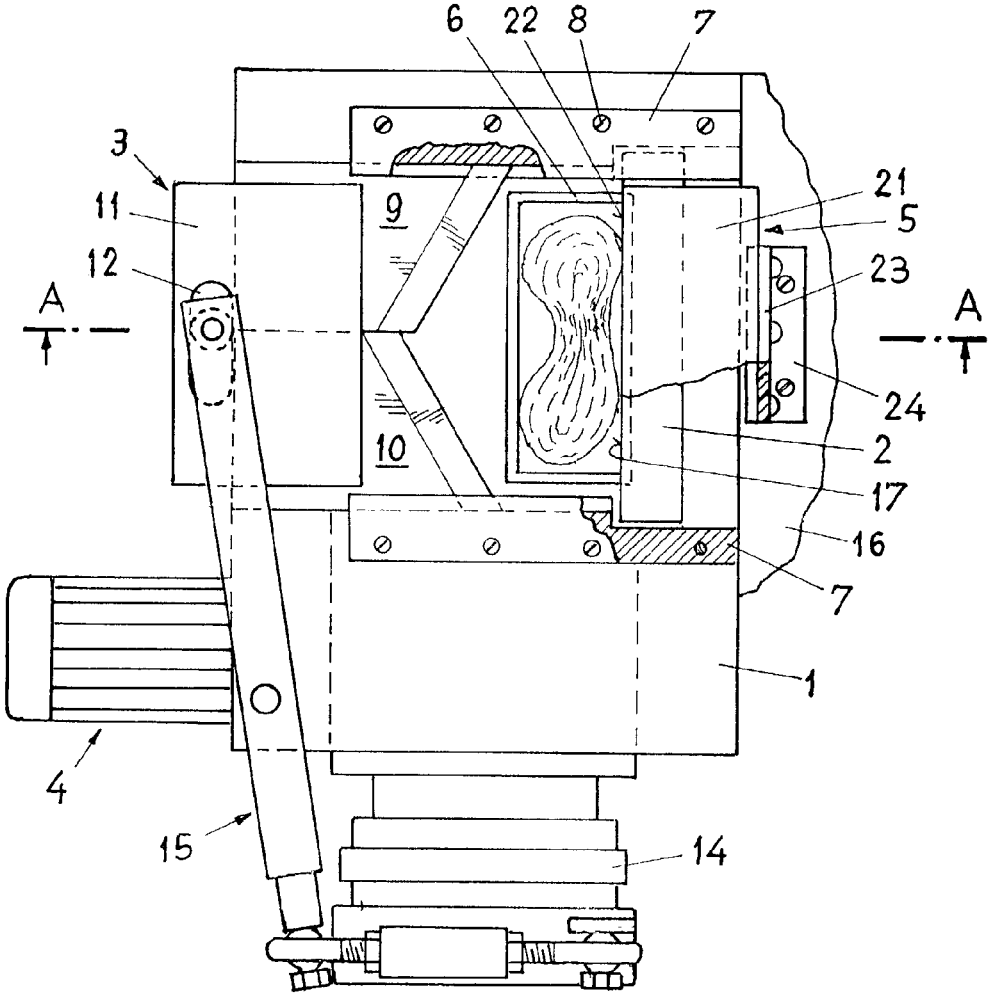
FIG. 1 a view of an embodiment of a cutting apparatus, in accordance with the invention.

The cutting apparatus comprises essentially a base plate 1, a fixed knife 2, a movable knife 3, a drive apparatus 4 for the movable knife and a counter-support supporting the packaging material during cutting.

The base plate 1 is mounted on a shaft 6 for feeding the cushion-like packaging material. Guide rails 7 for the movable knife 3 are fixed on the base plate 1 with suitable means 8. The fixed knife 2 is fixed on the base plate 1. The movable knife 3 comprises two part knives 9, 10 and a connection plate 11, on which the part knives are fastened and which has an elongated hole 12, in order to connect the movable knife to the drive apparatus described in the following. The part knives are fastened to the connection plate 11 in such a manner that their cutting edges are offset from one another and together form a diverging cutting edge with relation to the opening of the shaft 6. The movable knife 3 is connected to the drive apparatus 4 via a clutch 14 and a lever arrangement 15. The clutch 14 is a magnetic clutch with which the connection between the lever arrangement 15 and the drive apparatus 4 is established.

Figure 2:
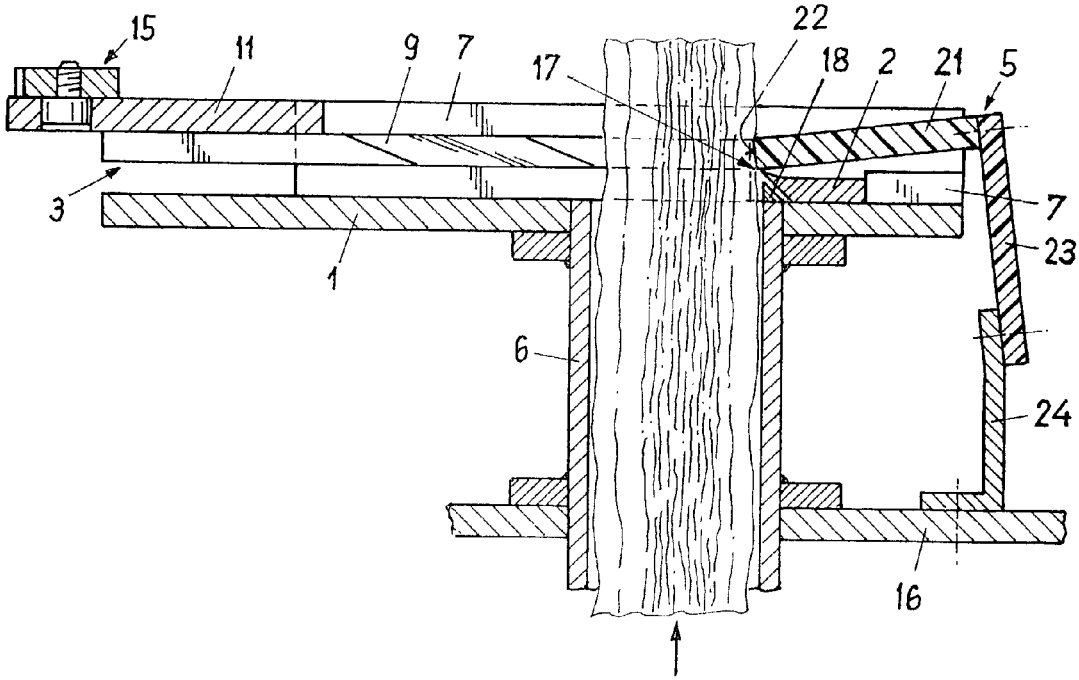
FIG. 2 a section along the line A—A in FIG. 1.
Figure 3:
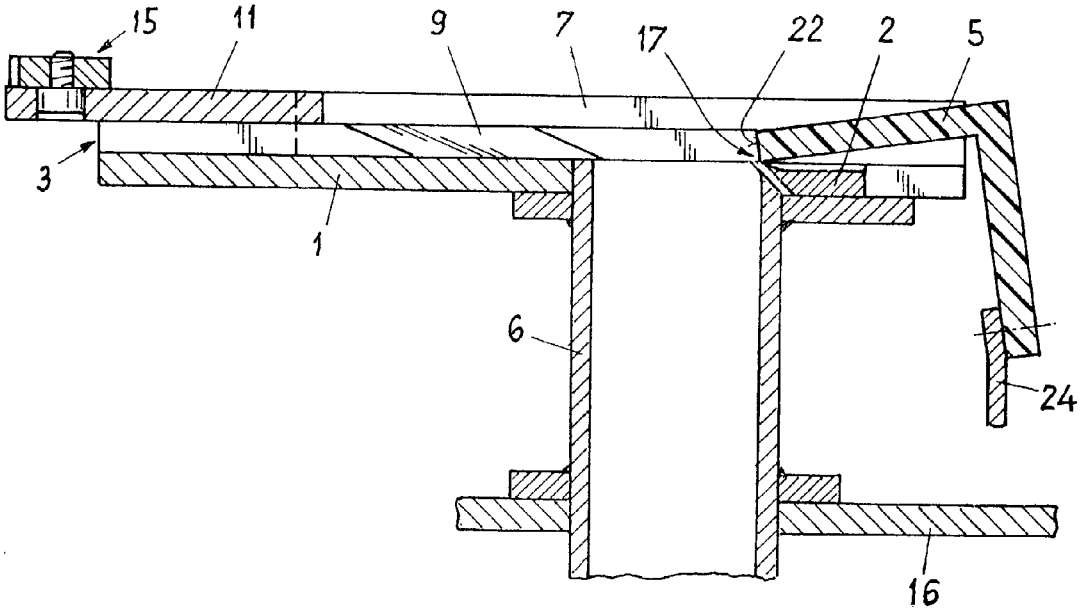
FIG. 3 a section along the line A—A of a modified embodiment.

Reference is made to FIGS. 2 and 3. As shown in FIG. 2, the base plate 1 is mounted in such a manner that the shaft 6 is flush with the upper side of the base plate 1. The shaft 6 is mounted on an machine frame 16. The fixed knife 2 is fastened on the base plate 1 in such a way that the cutting edge 17 extends up to three millimetres over the edge, which limits the opening of the shaft 6. A filler material 18 is arranged in the hollow cavity created by the undercut of the blade of the fixed knife, in order not to hinder the supply of the packaging material through the shaft 6.

The counter-holder contains a rectangular plate 21 and a holding plate 23. The plate 21 has a length which corresponds substantially to the longitudinal side of the cross-section of the shaft and is arranged obliquely above the fixed knife 2 in such a way that one longitudinal side lies flush with the cutting edge 17 of the fixed knife and forms a support surface 22 for the packaging material, the upper edge of the support surface projecting beyond the shaft opening. The holding plate 23 is fastened to the plate 21 and projects from the plate 21 at right angles. The holding plate 23 is fastened on to a supporting piece 24 which is mounted on the machine frame 16.

The plate 21 and the holding plate 23 are made of polyurethane with a Shore hardness in the range of approximately 80 to 105.

FIG. 3 shows a modified embodiment of the cutting apparatus. The modification is comprised in the fact that the fixed knife 2 is arranged in the base plate 1. For this purpose, the adjacent wall of the shaft is chamfered off at the same angle as the fixed knife. It is thus achieved that the hollow cavity between the inside of the shaft and the fixed knife 2 is reduced to a minimum. Furthermore the counter holder 5 is an angle section made of polyurethane.

Figure 4:
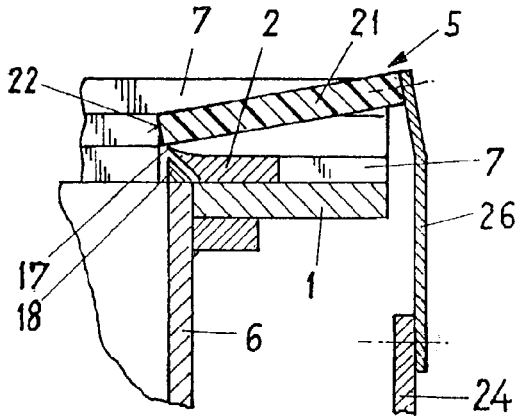
FIG. 4 a section of a further embodiment of a counter-holder.

The counter holder according to FIG. 4 contains a plate 21 made of an elastomer, for example polyurethane or similar. It is mounted on the machine frame 16 by means of a plate holder 26 formed as a leaf spring. The plate 21 can also be comprised of a thermosetting plastic, for example polyamide or similar. To reduce machine noise it is advantageous if the support surface is provided with a buffer element.

The movable knife 3 is displaced in the direction of the fixed knife 2 to cut the packaging material. The bead-like side edges are deformed by the cutting edges of the moving knife and what is more, in such a way that the loose layers of the side edges are displaced into the edge regions of the shaft 6 and pressed both against the wall of the shaft, against the fixed knife 2 and against the support surface 22 of the counter-holder. Due to the oblique position of the support surface, the packaging material emerging from the shaft 6 is not diverted in the direction of the fixed knife but in the direction of the movable knife. A contact of the packaging material is achieved respectively on both sides of the cutting edge of the fixed knife, which assures the cutting of the packaging material at the prescribed cutting line. By this means a dragging in of sections of individual layers of the bead-like side edges between the knives is prevented. During cutting, the counter-holder is lifted by the cutting edge of the movable knife. In this way the guide surface inclined relative to the shaft at the beginning of the cutting process is pivoted successively into a position parallel to the shaft, without losing contact with the packaging material.

What is claimed is:

1. Apparatus for the cutting of cushion-like packaging material from a web-like supply of material having at least two layers, said apparatus comprising a base plate (1) a fixed knife (2) and at least one movable knife (3), which are arranged above the base plate (1), and a drive apparatus (4) for the movable knife, wherein the base plate (1) is connected to a shaft (6) for supplying the packaging material, and the drive apparatus (4) is drivingly connected to the movable knife (3), characterized by at least partially elastic counter-holder (5) having a support surface (22) for supporting the packaging material during cutting, and by means (23; 24; 26) for holding the counter-holder (5) above the fixed knife (2), so that the support surface (22) is flush with a cutting edge (17) of the fixed knife (2) and extends at an angle toward the movable knife for deflecting the packaging material emerging from the shaft toward the movable knife, whereby the packaging material is cut along a prescribed cutting line.

2. Apparatus in accordance with claim 1, characterized in that the counter-holder (5) is formed in one piece or in two parts.

3. Apparatus in accordance with claim 1, characterized in that the counter-holder (5) is a rectangular plate, with a longitudinal side of the plate forming the support surface (22) and having a length, which substantially corresponds to a length of the longitudinal side of the shaft, and wherein the plate is fixed on the holding means (23; 24; 26) in a region of a longitudinal side located opposite the support-surface forming side.

4. Apparatus in accordance with claim 1, characterized in that the counter-holder (5) has a shape of an angle one limb of which forms the support surface (22), and the other limb is fixed to the holding means (23; 24; 26).

5. Apparatus in accordance with claim 1, characterized in that the counter-holder (5) comprises an elastomer.

6. Apparatus in accordance with claim 2, characterized in that the counter-holder (5) comprises a thermosetting plastic.

7. Apparatus in accordance with claim 1, characterized in that the holding means (26) is a rectangular plate made of polyurethane, which, on the one hand, is connected with the counter-holder (5) and, on the other hand, is mounted at a fixed location.

8. Apparatus in accordance with claim 1, characterized in that the holding means is a leaf spring (26), which is connected with the counter-holder (5) on one hand, and is mounted at a fixed location on the other hand.

* * * * *